US011012798B2

(12) United States Patent
Chau et al.

(10) Patent No.: US 11,012,798 B2
(45) Date of Patent: May 18, 2021

(54) CALIBRATION FOR SELF FITTING AND HEARING DEVICES

(71) Applicant: Sonova AG

(72) Inventors: Edward Chau, Waterloo (CA); Mennatallah Mostafa Hasabelnaby, Waterloo (CA); Leonard Cornelisse, Waterloo (CA); Isaac Hamp, Kitchener (CA)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/597,922

(22) Filed: Oct. 10, 2019

(65) Prior Publication Data

US 2021/0112350 A1 Apr. 15, 2021

(51) Int. Cl.
*H04R 25/00* (2006.01)

(52) U.S. Cl.
CPC ..... *H04R 25/70* (2013.01); *H04R 25/505* (2013.01); *H04R 25/554* (2013.01); *H04R 25/558* (2013.01); *H04R 2225/43* (2013.01); *H04R 2225/55* (2013.01)

(58) Field of Classification Search
CPC .. H04R 25/505; H04R 25/504; H04R 25/558; H04R 25/70; H04R 25/305; H04R 2225/43; H04R 2225/55
See application file for complete search history.

(56) References Cited

U.S. PATENT DOCUMENTS

2003/0078515 A1* 4/2003 Menzel ..... A61B 5/121 600/559
2016/0016618 A1* 1/2016 Wolf ..... B62D 35/02 296/180.5
2019/0082275 A1* 3/2019 Andersen ..... H04R 25/505

FOREIGN PATENT DOCUMENTS

EP 3427496 A1 1/2019

* cited by examiner

*Primary Examiner* — Sunita Joshi

(57) ABSTRACT

The disclosed technology relates to a self fitting hearing device and a method for self fitting the hearing device. Specifically, the disclosed technology relates to transmitting calibration signals from a wireless communication device to a hearing device so that the wireless communication device can provide signals or audio streams calibrated for a self-fitting for a hearing device. The wireless communication device can receive feedback from a hearing device that received a calibration signal and use this feedback to adjust signals it transmits to a hearing device for self fitting. More specifically, the hearing device receiving the calibration signal can determine whether the calibration actually received by the hearing device has criteria that meets a threshold for properly fitting the hearing device.

14 Claims, 3 Drawing Sheets

CALIBRATION FOR SELF FITTING AND HEARING DEVICES

TECHNICAL FIELD

The disclosed technology generally relates to a self-fitting hearing device and a method for self fitting the hearing device. Specifically, the disclosed technology relates to calibrating signals sent from a wireless communication to a hearing device so that a self fitting of the hearing device can be performed.

BACKGROUND

Self-fitting hearing aids are growing in popularity. A self-fitting hearing aid is a device that enables the hearing aid user to perform both threshold measurements leading to a prescribed hearing aid setting and fine-tuning without the need for audiological support or access to audiological equipment.

Self fitting also refers to the steps and/or operations performed by a user, hearing aid, or other device communicating with the hearing aid to fit a hearing aid for hearing assistance. Self fitting generally means the hearing aid user performs the steps and/or operations without the assistance of a hearing care professional (HCP), audiologist, or doctor. Self fitting can be performed at home or in a private location, at any time, and by a single hearing aid user.

However, a hearing aid user may not be able to sufficiently self fit a hearing aid because the hearing aid users generally lack access to a fitting station designed for fitting a hearing aid. A fitting station is a computer that is configured to provide calibrated sounds to a hearing aid user to determine a degree of user's hearing loss. Furthermore, hearing aid users may not know how to use a fitting station or fitting software associated with a fitting station because hearing aid users generally do not have a background in fitting hearing aids.

Accordingly, there exists a need for a hearing device, system, method, and/or software that enables a hearing device user to perform a self-fitting procedure to self fit a hearing device, e.g., without consulting a professional or using a fitting station.

Figure 1:
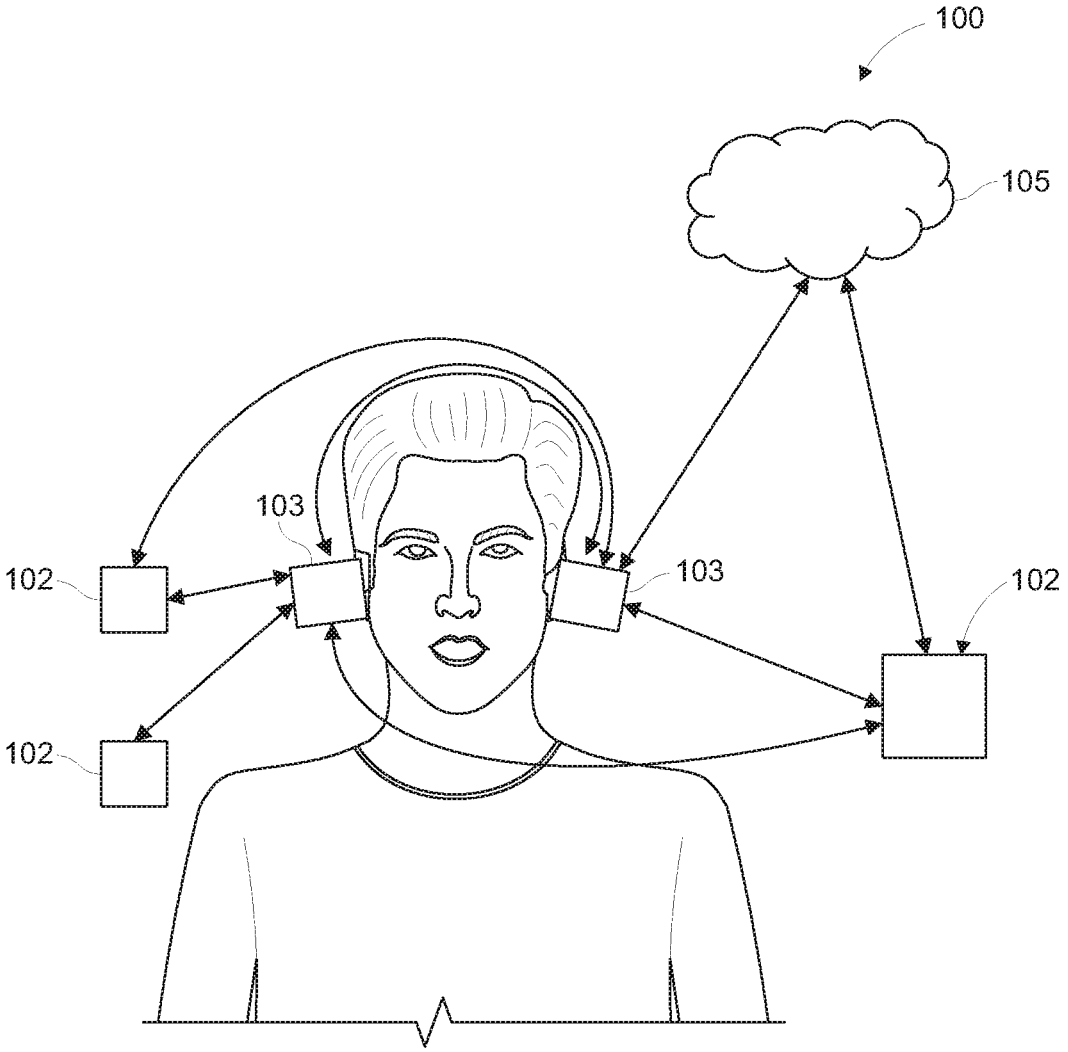
FIG. 1 is a schematic illustration of a hearing device user wearing hearing devices in accordance with some implementations of the disclosed technology.

The drawings are not to scale. Some components or operations may be separated into different blocks or combined into a single block for the purposes of discussion of some of the disclosed technology. Moreover, while the disclosed technology is amenable to various modifications and alternative forms, specific implementations have been shown by way of example in the drawings and are described in detail below. The intention, however, is not to limit the technology to the selected implementations described. Rather, the disclosed technology is intended to cover all modifications, equivalents, and alternatives falling within the scope of the technology as defined by the appended claims.

DETAILED DESCRIPTION

Self-fitting hearing aids utilize consumer-grade computing devices and self-fitting workflows that can cause problems not typically found in fitting stations at an HCP's office. For example, a user attempting to fit a hearing aid by himself with a mobile phone can adjust the volume of the mobile phone using the volume control to adjust the volume of output test signals from the mobile phone used for the self fitting. However, because the mobile phone does not use a standard volume control and the user can adjust the volume however he or she sees fit, it is not possible for the hearing aid user to properly calibrate or know how to calibrate signals transmitted by a mobile phone device. Furthermore, hearing aid users are not generally trained in fitting hearing aids and may not understand how a signal should be calibrated.

Also, self fitting a hearing aid with a consumer electronics device generally assumes that a frequency response of a streamed signal at the hearing device is the same as the frequency response at the consumer electronics device, but this may not be true. For example, after gain is applied at a hearing device, the output of a signal at a hearing device may be different than it was at the wireless communication device. One reason for this difference may be venting of the hearing device. Also, a consumer grade electronic device can transmit signals at unpredictable levels as there is no standard for transmitting or streaming audio signals even when using wireless protocols (e.g., BLUETOOTH™).

To address these shortcomings and provide additional benefits, the disclosed technology includes a wireless communication device, a hearing device, a method, and a computer-implemented method for calibrating a signal transmitted from a wireless communication device to a hearing device for self fitting a hearing device. The wireless communication device can receive feedback from a hearing device that received a calibration signal and use this feedback to adjust signals it transmits to a hearing device for self fitting. More specifically, the hearing device receiving the calibration signal can determine whether the calibration signal actually received by the hearing device has criteria that meets a threshold for properly fitting the hearing device.

The hearing device can communicate this feedback to the wireless communication device for adjusting of the calibration signal until the wireless communication device is calibrated for the self fitting. More specifically, a wireless communication device is calibrated and meets the criteria when a hearing device provides feedback that signals received from the wireless device can be used for self fitting. After calibration, the wireless communication device can transmit an audio stream signal as part of a self fitting that is an equivalent to an acoustic version of the signal for accurate self fitting. The hearing device and hearing device user can use this audio stream for self fitting a hearing device.

In some implementations, a wireless communication device wirelessly transmits a first calibration signal to the hearing device. The hearing device receives and analyzes the calibration signal. For example, the calibration signal can be an audio stream signal and the hearing device can determine a frequency or level of the calibration signal (e.g., locally at a hearing aid). The hearing device can use this analysis to transmit feedback to the wireless communication device.

For example, if the hearing device determines that the calibration signal is too loud, too soft, not the right frequency for a self fitting based on the capability of the hearing device, and/or determines the frequency response of the calibration meet the criteria, it can transmit this feedback to the wireless communication device or transmit criteria for changing the calibration signal so that it is suitable for a self fitting.

The wireless communication device can receive the feedback from the hearing device and adjust its calibration signal. In some implementations, the feedback can indicate the calibration signal meets the criteria for a self fitting and the wireless communication device can be used for a self fitting. In other implementations, the feedback can indicate the calibration signal did not meet the criteria for self fitting and the wireless communication device can adjust a calibration signal and transmit a second calibration signal based on the feedback.

The wireless communication device can transmit various calibration signals. Some calibration signals can include particular frequencies or types of signals (e.g., audio versus noise or a mix). Some calibration signals can be different input levels or amplitudes (e.g., loud or soft). The hearing device can determine how the calibration signal was actually received by the hearing device and transmit feedback to the wireless communication device for further adjustment using a processor in the hearing device. In some implementations, a mobile application installed on the wireless communication device performs the operations for calibration.

Although the hearing device may perform analysis of calibration signals, the wireless device can also analyze the calibration signals received at the hearing device. For example, the wireless communication device can query the hearing device regarding a recently transmitted calibration signal. The wireless communication device can receive information regarding the calibration signal (e.g., input level) and use it to compare with a predefined acceptable input level. The wireless communication device can make adjusts to the calibration signal based on the comparison between the predefined information and the information that the wireless communication device received from the hearing device.

The hearing device can also calibrate itself locally. The hearing device can receive a calibration signal and attenuate or adjust the calibration signal to meet criteria for a self fitting. If hearing device cannot attenuate or adjust the calibration signal to meet the criteria based on its analysis of the calibration, it can request the wireless communication device transmit another calibration signal that is adjusted to meet the criteria for a self fitting. In other implementations, the hearing device and wireless communication device can both make adjustments to calibrate signals for self fitting, e.g., divide or split the adjustments among the two devices through coordination.

In some implementations, the disclosed technology solves a technical problem with a practical application of a technical solution. Specifically, consumer devices are not calibrated for transmitting signals to a hearing device for self fitting because consumer devices have different types of hardware and software that is not designed according to calibration standards for self fitting. Additionally, when a calibration signal is transmitted from a wireless communication device to a hearing device, it may be received by the hearing device differently than intended (e.g., the calibration signal may be softer or louder when actually received due to differences in designs of the devices). The disclosed technology addresses these issues and provides additional benefits because the hearing device enables self fitting regardless of the type of wireless communication device used to fit the hearing device. Also, the disclosed technology provides for a more accurate fit for the hearing device user because the signals used for self fitting are calibrated.

FIG. 1 illustrates a communication environment 100. The communication environment 100 includes wireless communication devices 102 and hearing devices 103 (also referred to as a single wireless communication device 102 and multiple wireless communications devices 102; or a signal hearing device 103 and multiple hearing devices 103). A self-fitting hearing device can be fit in the communication environment 100 as explained throughout this disclosure.

As shown by double-headed bold arrows in FIG. 1, the wireless communication devices 102 and the hearing devices 103 can communicate wirelessly. Wireless communication can include using a wireless communication protocol such as Bluetooth BR/EDR™, Bluetooth Low Energy™, a proprietary communication (e.g., binaural communication protocol between hearing aids or bimodal communication protocol between a hearing aid and hearing device), ZigBee™ Wi-Fi™, or an Institute of Electrical and Electronics Engineers (IEEE) wireless communication standard protocol.

Also, as shown by the double-headed bold arrows in FIG. 1, the wireless communication device 102 can transmit calibration signals, stream audio information, or communicate with the hearing devices 103. For example, during a calibration test as described in more detail in FIGS. 2 and 3, the wireless communication device 102 can transmit a first calibration signal to the hearing device 103, the hearing device 103 can analyze the first calibration signal and send this analysis back to the wireless communication device 102, and the wireless communication device 102 can use this analysis to determine whether the signals transmitted by the wireless communication device 102 can be used by the hearing device for a self fitting or whether the wireless communication device 102 should transmit another adjusted calibration signal to determine if the adjusted signal can be used by the hearing device 103 for self fitting. The wireless communication device 102 and the hearing device 103 can continue to transmit and receive information related to the calibration signal until it is determined that the signals transmitted from the wireless communication device 102 can be used (e.g., are calibrated) for a self fitting.

The hearing devices 103 are configured to provide sound to a hearing device user. Some example hearing devices include hearing aids, headphones, earphones, assistive listening devices, or any combination thereof; and hearing devices include both prescription devices and non-prescription devices configured to be worn on or near a human head. As an example of a hearing device, a hearing aid is a device that provides amplification, attenuation, or frequency modification of audio signals to compensate for hearing loss or difficulty. Hearing aids include Behind-the-Ear (BTE), Receiver-in-the-Canal (MC), In-the-Ear (ITE), Completely-in-the-Canal (CIC), Invisible-in-the-Canal (IIC) hearing aids or a cochlear implant (where a cochlear implant includes a device part and an implant part).

Also, the hearing devices 103 can be configured to binaurally communicate or bimodally communicate. The binaural communication can include a hearing device 103 transmitting information to or receiving information from another hearing device 103. Information can include volume control, signal processing information (e.g., noise reduction, wind canceling, directionality such as beam forming information), or compression information to modify sound fidelity or resolution. Binaural communication can be bidirectional (e.g., between hearing devices) or unidirectional (e.g., one hearing device receiving or streaming information from another hearing device). Bimodal communication is like binaural communication, but bimodal communication includes a cochlear device communicating with a hearing aid. For example, the hearing devices 103 can communicate information regarding calibrations signals or self-fitting information.

The wireless communication devices 102 are computing devices that are configured to wirelessly communicate. The wireless communication devices 102 can include computers (e.g., desktop, server, laptop), televisions (TVs) or components in communication with a TV (e.g., TV streamer), a car audio system or circuitry within the car, a mobile device (e.g., smartphone), tablet, remote control, an accessory electronic device, a wireless speaker, or watch. The wireless communication devices 102 can transmit audio information or self fitting information to a hearing device 103 (e.g., stream audio as part of a self fitting). Accordingly, the disclosure provides details for how the wireless communication devices 102 can be calibrated to a specific hearing device. Although generally a hearing device user can use a single wireless communication device 102 to self fit a hearing device, he or she can also use multiple wireless communication devices 102 to self fit a hearing device.

The network 105 is a communication network. The network 105 enables the hearing devices 103 or the wireless communication devices 102 to communicate with a network or other devices. For example, the wireless communication device 102 can receive information from the network 105 to execute a self fitting for a hearing aid. In some implementations, the wireless communication device 102 and the hearing device 103 can share calibration information via the network 105, wherein the calibration information can be used by hearing device manufacturers to improve or monitor the self fitting or calibration process. The wireless communication device 102 can also download a mobile application from the network 105, where the mobile application can provide a graphical user interface and software for performing a self fitting for a hearing device 103.

The network 105 can be a Wi-Fi™ network, a wired network, or a network implementing any of the Institute of Electrical and Electronic Engineers (IEEE) 802.11 standards. The network 105 can be a single network, multiple networks, or multiple heterogeneous networks, such as one or more border networks, voice networks, broadband networks, service provider networks, Internet Service Provider (ISP) networks, and/or Public Switched Telephone Networks (PSTNs), interconnected via gateways operable to facilitate communications between and among the various networks. In some implementations, the network 105 can include communication networks such as a Global System for Mobile (GSM) mobile communications network, a code/time division multiple access (CDMA/TDMA) mobile communications network, a 3rd, 4th or 5th generation (3G/4G/5G) mobile communications network (e.g., General Packet Radio Service (GPRS)) or other communications network such as a Wireless Local Area Network (WLAN).

Figure 2:
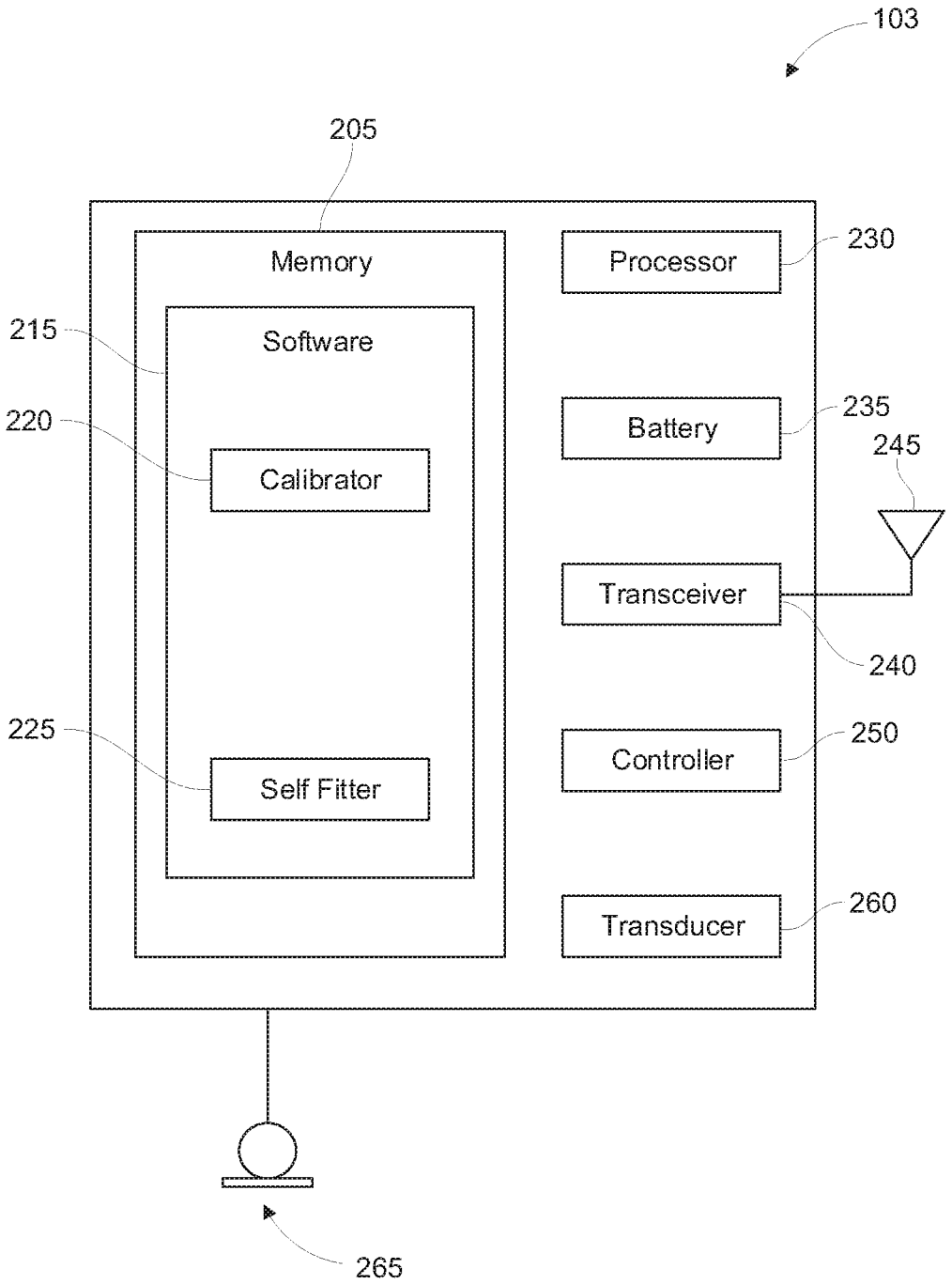
FIG. 2 is a schematic illustration of a hearing device from FIG. 1 in more detail in accordance with some implementations of the disclosed technology.

FIG. 2 is a block diagram illustrating the hearing device 103 from FIG. 1 in more detail. FIG. 2 illustrates the hearing device 103 with a memory 205, software 215 stored in the memory 205, the software 215 includes a calibrator 220 and a self fitter 225. The hearing device 103 also includes a processor 230 (e.g., configured to communicate with a Digital Signal Processor (DSP)), a battery 235, a transceiver 240, an antenna 245, a controller 250, a transducer 260, and a microphone 265.

The memory 205 stores instructions for executing the software 215 comprised of one or more modules and data utilized by the modules. The modules perform certain methods or functions for the hearing device 103 and can include components, subcomponents, or other logical entities that assist with or enable the performance of these methods or functions. Although a single memory 205 is shown in FIG. 2, the hearing device 103 can have multiple memories 205 that are partitioned or separated, where each memory can store different information.

The calibrator 220 can be used to analyze or transmit information related to calibration signals. The calibrator 220 can communicate with the processor 230 to determine properties of a received calibration signal (e.g., the processor 230 can be a DSP or use a DSP electronically coupled to the processor 230). The calibrator 220 can also determine whether a received calibration signal meets criteria for self fitting. For example, the calibrator 220 may have a threshold input levels or threshold frequencies that are required for a successful calibration. It can compare these threshold levels and/or frequencies to the received calibration signal to determine whether the received calibration signal meets the criteria.

The self fitter 225 can perform self fitting operations. The self fitter 225 can instruct the hearing device 103 to output audio signals or announcements as part of a self fitting. The self fitter 225 can also receive feedback from the user such as a signal was too loud or too soft (e.g., based on a user toggling a user input on the hearing device or using a graphical user interface for a mobile phone connected to the hearing device). The self fitter 225 can also communicate with the calibrator 220 to determine when a wireless communication device has been successfully calibrated for a self fitting. The self fitter 225 can also use information from a user's voice commands to receive feedback (e.g., a user can say a sound is too loud or soft and the self fitter 225 can use the processor 230 to determine what was verbally said).

The processor 230 can include special-purpose hardware such as application specific integrated circuits (ASICs), programmable logic devices (PLDs), field-programmable gate arrays (FPGAs), programmable circuitry (e.g., one or more microprocessors microcontrollers), DSP, appropriately programmed with software and/or computer code, or a combination of special purpose hardware and programmable circuitry.

Also, although the processor 230 is shown as a separate unit in FIG. 2, the processor 230 can be on a single chip with the transceiver 240, the controller 250, and the memory 205. The processor 230 can also include a DSP configured to modify audio signals based on hearing loss or hearing programs stored in the memory 205. In some implementations, the hearing device 103 can have multiple processors, where the multiple processors can be physically coupled to the hearing device 103 and configured to communicate with each other.

The battery 235 can be a rechargeable battery (e.g., lithium ion battery) or a non-rechargeable battery (e.g., Zinc-Air) and the battery 235 can provide electrical power to the hearing device 103 or its components.

The antenna 245 is configured to operate in unlicensed bands such as ISM using a frequency of 2.4 GHz (or near 2.4 GHz). The antenna 245 can be configured to operate in other frequency bands such as 5 GHz, 5 MHz, 10 MHz, or other unlicensed bands. The antenna 245 can be configured to implement transmission and reception of information according to any Bluetooth™ standard, ZigBee™, or wireless communication standard for hearing devices.

The controller 250 controls transmission or reception of packets based on requests from the hearing device 103 (e.g., from the processor 230 according to a wireless communication protocol such as Bluetooth BR/EDR™). The controller 250 can be implemented in hardware (e.g., part of the processor 230 or be a separate unit), software (e.g., part of software 215), or a combination of software and hardware. The controller 250 can be configured to communicate with the transceiver 240 to transmit or receive packets such as audio packets or signaling packets.

The transducer 260 is configured to provide audio signals to the hearing device user. For example, the transducer 260 can be a loudspeaker or a transducer for a cochlear device configured to transmit or convert audio signals into nerve stimulation or electrical signals. The transducer 260 can be physically coupled to the hearing device 103 or located in separate device (e.g., implant portion of cochlear implant). In some implementations, the transducer 260 is connectable to a wire such that the transducer 260 can be inserted into the hearing device user's ear (e.g., for a RIC hearing aid). In some implementations, the transducer 260 is a loudspeaker and it can output audio signals as part of a self fitting test.

The microphone 265 is configured to capture sound and provide an audio signal of the captured sound to the processor 230. The processor 230 can modify the sound (e.g., in a DSP) and provide the modified sound to a user of the hearing device 103. Although a single microphone 265 is shown in FIG. 2, the hearing device 103 can have more than one microphone. For example, the hearing device 103 can have an inner microphone, which is positioned near or in an ear canal, and an outer microphone, which is positioned on the outside of an ear. As another example, the hearing device 103 can have two microphones, and the hearing device 103 can use both microphones to perform beam forming operations. In such an example, the processor 230 would include a DSP configured to perform beam forming operations.

Although not shown in FIG. 2, the hearing device can include other components such as an accelerometer, sensor, or vent (e.g., active vent).

Figure 3:
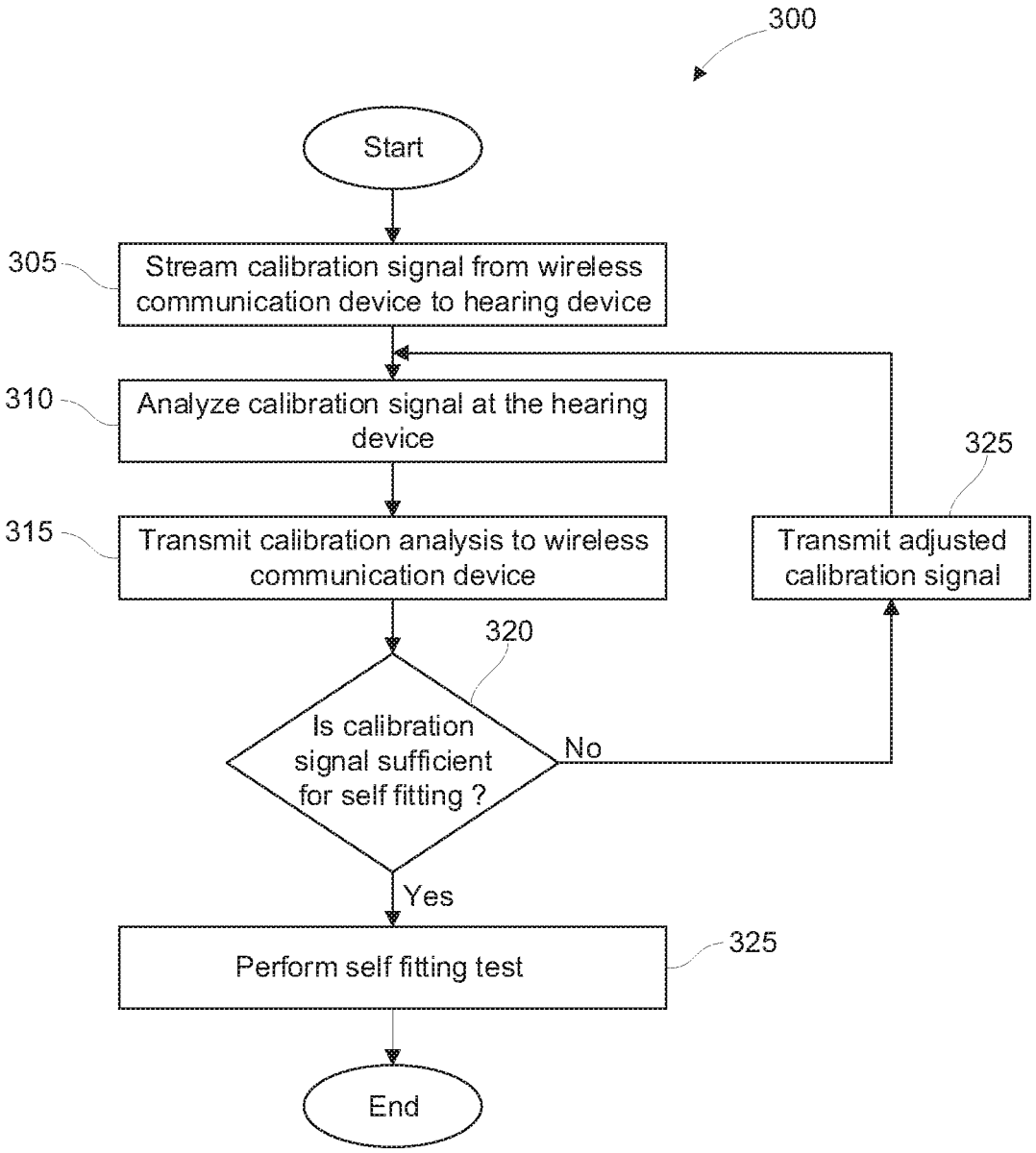
FIG. 3 is a block flow diagram for a process to a calibrate signal and initiate a self fitting in accordance with some implementations of the disclosed technology.

FIG. 3 is a block-flow diagram for a process 300 to provide a calibrated signal to a hearing device and perform a self-fitting. In some implementations, the process 300 is carried out by a hearing device (e.g., hearing device 103, FIG. 1), carried out by a wireless communication device (e.g., wireless communication device 102, FIG. 1), or both the hearing device and the wireless communication device. The process 300 begins at the stream calibration signal operation 305 and continues to analyze calibration signal operation 310. As disclosed in more detail, some operations of the process 300 may be repeated or performed out of order. The process 300 may be executed automatically based on user input from a mobile application communicating with the wireless communication device.

At stream calibration signal operation 305, a wireless communication device transmits a calibration signal to a hearing device. For example, a mobile phone can transmit a signal with a frequency, level, and other audio characteristic to the hearing device. In some implementations, the wireless communication device can initiate the operation 305 based on input from a mobile application or application; in other implementations, the wireless communication device can receive a request from the hearing device to initiate the stream calibration signal operation 305. Prior to the operation 305, the wireless communication device and hearing device can pair, authenticate, and/or wirelessly connect using a wireless communication protocol (BLUETOOTH™).

At analyze calibration signal operation 310, a hearing device analyzes the calibration signal. The hearing device can determine a frequency of the calibration signal, a level (e.g., output level, amplitude, volume), or other audio characteristic of the calibration signal. For example, the calibration signal can be transmitted with an input level (L1) and the hearing device can receive the calibration signal and determine what input level exists in the calibration signal. The received input level of the calibration signal may be different than the transmitted input level because the transmitted device may have different properties or be calibrated differently. For example, a mobile phone may be calibrated to a mobile device standard for L1 or during the manufacture of the device the tolerance of the device may be adjusted to transmit an input level in a range that is not acceptable for a hearing device. The hearing device can analyze the calibration signal in its DSP. In some implementations, the hearing device does not even need to provide an acknowledgment to the user that it is analyzing a calibration; rather, it can simply analyze the signal internally and then transmit its analysis to the wireless communication device in the next operation.

In some implementations of the analyze calibration signal operation 310, the wireless communication device carries out the analysis of the calibration signal. For example, the hearing device may transmit information regarding how the calibration signal was received at the hearing device, and the wireless communication device can use this information to determine whether the calibration sufficiently met the criteria for self fitting. For example, the mobile device can read measured input signal levels from the hearing device and compare these input signal levels to a predefined range of acceptable input levels (e.g., A, B).

At transmit calibration analysis operation 315, the hearing device transmits feedback based on the received calibration signal to the wireless communication device. In some implementations, the hearing device determines that the calibration signal meets the criteria to be used for a self fitting test or meets the calibration signal criteria and thus the feedback is simply that the calibration signal was adequate and can be used again. In other implementations, the hearing device transmits feedback that includes the differences between the properties of the actual calibration signal versus required properties for a calibration test or self fitting test.

At determine signal sufficiency operation 320, the wireless communication device determines whether the calibration signal met the criteria for the hearing device and a self fitting or whether the signal needs to be adjusted and an adjusted calibration signal (e.g., second calibration signal) needs to be transmitted to the hearing device. Based on the feedback from the calibration analysis operation 315, the wireless communication device can determine whether the criteria for the calibration signal were met. If the calibration signal is sufficient (e.g., meets the criteria), the process 300 continues to the perform self fitting test operation 325. If the calibration signal is not sufficient (e.g., does not meet the criteria), the process 300 proceeds to transmit adjusted calibration signal operation 325. For example, the wireless communication device can determine that the input level associated with a calibration signal received at the hearing device was too low and it should be increased (e.g., the volume needs to be increased). The wireless communication device can also receive feedback or analysis that indicates the calibration meets the criteria and thus no further adjustments are required. In some implementations, the determine signal sufficiency operation 320 can occur on the hearing device or on both the hearing device and the wireless communication device.

At perform self fitting test operation 325, the wireless communication device and the hearing device can perform a self fitting test based on results from the calibration signal. The self fitting can include the wireless communication device transmitting signals that are based on a calibration signal that meets criteria (as discussed in operations 305-320). The self fitting test can include streaming audio signals with certain frequencies or volumes, where the certain frequencies or volumes can be determined based on the successful calibration signal. The self fitting can include a speech-in-noise test, clarity testing, own voice testing, naturalness testing, and fitting at low, medium, and high frequencies. In some implementations, the wireless communication device begins a self fitting test based on user input at a graphical user interface and streaming audio signals that are calibrated for a hearing device. The signals that are transmitted as part of self fitting can also be referred to as "self-fitting" signals.

Aspects and implementations of the process 300 of the disclosure have been disclosed in the general context of various steps and operations. A variety of these steps and operations may be performed by hardware components or may be embodied in computer-executable instructions, which may be used to cause a general-purpose or special-purpose processor (e.g., in a computer, server, or other computing device) programmed with the instructions to perform the steps or operations. For example, the steps or operations may be performed by a combination of hardware, software, and/or firmware such with a wireless communication device or a hearing device. In some implementations, the process 300 can automatically start as soon as a user opens a mobile application with his or her smartphone to begin a self-fitting. In some implementations, the certain operations of 300 can be performed out of order, skipped, or repeated. For example, the transmit adjusted calibration operation 325 can be repeated several times to continually adjust a signal or can be repeated with different types of signals (e.g., at different frequencies).

The phrases "in some implementations," "according to some implementations," "in the implementations shown," "in other implementations," and generally mean a feature, structure, or characteristic following the phrase is included in at least one implementation of the disclosure, and may be included in more than one implementation. In addition, such phrases do not necessarily refer to the same implementations or different implementations.

The techniques introduced here can be embodied as special-purpose hardware (e.g., circuitry), as programmable circuitry appropriately programmed with software or firmware, or as a combination of special-purpose and programmable circuitry. Hence, implementations may include a machine-readable medium having stored thereon instructions which may be used to program a computer (or other electronic devices) to perform a process. The machine-readable medium may include, but is not limited to, optical disks, compact disc read-only memories (CD-ROMs), magneto-optical disks, ROMs, random access memories (RAMs), erasable programmable read-only memories (EPROMs), electrically erasable programmable read-only memories (EEPROMs), magnetic or optical cards, flash memory, or other type of media/machine-readable medium suitable for storing electronic instructions. In some implementations, the machine-readable medium is non-transitory computer readable medium, where in non-transitory excludes a propagating signal.

The above detailed description of examples of the disclosure is not intended to be exhaustive or to limit the disclosure to the precise form disclosed above. While specific examples for the disclosure are described above for illustrative purposes, various equivalent modifications are possible within the scope of the disclosure, as those skilled in the relevant art will recognize. For example, while processes or blocks are presented in an order, alternative implementations may perform routines having steps, or employ systems having blocks, in a different order, and some processes or blocks may be deleted, moved, added, subdivided, combined, or modified to provide alternative or subcombinations. Each of these processes or blocks may be implemented in a variety of different ways. Also, while processes or blocks are at times shown as being performed in series, these processes or blocks may instead be performed or implemented in parallel, or may be performed at different times. Further any specific numbers noted herein are only examples: alternative implementations may employ differing values or ranges.

As used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc. As another example, "A or B" can be only A, only B, or A and B.

The invention claimed is:

1. A computer-implemented method for initiating a self fitting of a hearing device, the method comprising:

receiving wirelessly a first calibration signal from a wireless communication device;

determining whether the first calibration signal meets criteria for performing a self fitting;

transmitting a first feedback signal to the wireless communication device based on whether the first calibration signal meets the criteria;

receiving wirelessly a second calibration signal from the wireless communication device, wherein the second calibration signal was adjusted based on the first feedback signal;

determining that second calibration signal meets the criteria for performing the self fitting and transmitting a second feedback signal to the wireless communication device indicating that the second calibration signal meets the criteria; and receiving a self-fitting signal from the wireless communication device and using the self-fitting signal to perform a self fitting for the hearing device, wherein the self-fitting signal is derived from information associated with the first feedback signal or the second feedback signal, wherein the first and the second calibration signal are associated with properties or settings of the wireless communication device.

2. The computer-implemented method of claim 1, wherein the criteria are associated with a frequency characteristic or an input level for performing a self fitting for the hearing device.

3. The computer-implemented method of claim 1, wherein the criteria are associated with level values of signals received at the hearing device.

4. The computer-implemented method of claim 1, wherein the first calibration signal is a streamed audio signal with an input level and determining whether the first calibration signal meets the criteria includes comparing the input level to a predefined input level, wherein the predefined input level is acceptable for a self fitting test.

5. The computer-implemented method of claim 1, wherein the first and second feedback signal include information related to an input level or frequency of the first or second calibration signal as received by the hearing device.

6. The computer-implemented method of claim 1, wherein the self-fitting signal is associated with a volume or frequency to determine whether a hearing device user is capable of hearing the volume or frequency.

7. The computer-implemented method of claim 1, receiving a signal from the wireless communication device indicating that the self fitting will start within a few seconds, wherein the signal is associated with a hearing device user touching a graphical user interface for the wireless communication device.

8. A computer program product including instructions that when executed by a processor or processors, cause a hearing device to perform calibration operations for a self fitting, the operations comprising:

receive wirelessly a first calibration signal from a wireless communication device;

determine whether the first calibration signal meets criteria for performing a self fitting;

transmit a first feedback signal to the wireless communication device based on whether the first calibration signal meets the criteria;

receive wirelessly a second calibration signal from the wireless communication device, wherein the second calibration signal was adjusted based on the first feedback signal;

determine that the second calibration signal meets the criteria for performing the self fitting and transmit a second feedback signal to the wireless communication device indicating that the second calibration signal meets the criteria; and receive a self-fitting signal from the wireless communication device and use the self-fitting signal to perform a self fitting for the hearing device, wherein the self-fitting signal is derived from information associated with the first feedback signal or the second feedback signal, wherein the first and the second calibration signal are associated with the properties or settings of the wireless communication device.

9. The computer program product of claim 8, wherein the self-fitting signal is associated with a speech-in-noise audio signal.

10. The computer program product of claim 8, wherein the operations further comprise:

provide, at the hearing device, the self-fitting signal or a modified self-fitting signal to a hearing device user;

receive user feedback regarding the self-fitting signal or the modified self-fitting signal; and adjust the hearing device based on the user feedback.

11. The computer program product of claim 8, wherein the criteria are associated with level values of signals received at the hearing device.

12. The computer program product of claim 8, wherein the first calibration signal is a streamed audio signal with an input level and determining whether the first calibration signal meets the criteria includes comparing the input level to a predefined input level, wherein the predefined input level is acceptable for a self fitting test.

13. A hearing device, the hearing device comprising:

a processor configured to perform digital signal processing operations;

a memory storing instructions that when executed by a processor cause a hearing device to perform operations, the operations comprising:

receive wirelessly a first calibration signal from a wireless communication device;

determine whether the first calibration signal meets criteria for performing a self fitting;

transmit a first feedback signal to the wireless communication device based on whether the first calibration signal meets the criteria;

receive wirelessly a second calibration signal from the wireless communication device, wherein the second calibration signal was adjusted based on the first feedback signal;

determine that the second calibration signal meets the criteria for performing the self fitting and transmit a second feedback signal to the wireless communication device indicating that the second calibration signal meets the criteria; and receive a self-fitting signal from the wireless communication device and use the self-fitting signal to perform a self fitting for the hearing device, wherein the self-fitting signal is derived from information associated with the first feedback signal or the second feedback signal, wherein the first and second feedback signal include information related to an input level or frequency of the first or second calibration signal as received by the hearing device or wherein the self-fitting signal is associated with a volume level or frequency to determine whether a hearing device user is capable of hearing the volume level or frequency.

14. The hearing device of claim 13, wherein the operations further comprise:

provide, at the hearing device, the self-fitting signal or a modified self-fitting signal to a hearing device user;

receive user feedback regarding the self-fitting signal or the modified self-fitting signal; and adjust the hearing device based on the user feedback.

* * * * *